US005979563A

United States Patent [19]

Fritz

[11] Patent Number: 5,979,563

[45] Date of Patent: Nov. 9, 1999

[54] METHOD AND APPARATUS FOR PROVIDING PRESSURIZED WATER TO A RESIDENTIAL FIRE SPRINKLER SYSTEM IN THE ABSENCE OF ELECTRICITY

[76] Inventor: Robert K. Fritz, 6500 Union Deposit Rd., Harrisburg, Pa. 17111

[21] Appl. No.: 09/025,102

[22] Filed: Feb. 17, 1998

[51] Int. Cl.[6] ..... A62C 35/00

[52] U.S. Cl. ..... 169/5; 169/13

[58] Field of Search ..... 169/5, 7, 8, 9, 169/13, 46, 51; 417/17, 393, 395, 46

[56] References Cited

U.S. PATENT DOCUMENTS

| | | | |
|---|---|---|---|
| 241,000 | 5/1881 | Granger | 169/5 |
| 533,449 | 2/1895 | Erwin | 417/393 |
| 851,863 | 4/1907 | Buell | 169/5 |
| 3,782,863 | 1/1974 | Rupp | 417/393 |
| 4,419,056 | 12/1983 | Ege | 417/426 |
| 4,854,832 | 8/1989 | Gardner | 417/393 |
| 5,055,007 | 10/1991 | Geddings | 417/393 |

OTHER PUBLICATIONS

ARO Air–Operated Diaphragm Pumps—Ingersoll Rand Fluid Products, ARO Fluid Products Production Equipment Group, pp. 10–11, dated 1997.

Amtrol Pump Tank Lines, Amtrol Inc., p. 2, dated Aug., 1997.

*Primary Examiner*—Andres Kashnikow
*Assistant Examiner*—Jorge Bocanegra
*Attorney, Agent, or Firm*—Woodcock Washburn Kurtz Mackiewicz & Norris LLP

[57] ABSTRACT

A method and apparatus for providing pressurized water to a residential fire sprinkler system in the absence of electricity. The apparatus includes a double diaphragm pump operated from compressed nitrogen gas.

The pump includes a housing containing a pair of flexible diaphragms mechanically connected and separating the housing into a pair of pressurized chambers and a pair of pumping chambers. The pressure chambers are connected to a supply of compressed nitrogen gas. The inlet to the pumping chambers is connected to any water supply and the outlet to the pumping chambers is connected to a residential fire sprinkler system. Compressed nitrogen gas is alternately supplied to the pressure chambers and alternately discharges the gas from the pressure chambers thereby causing water from the water supply to flow alternately into one of the pumping chambers and to be discharged alternately from the other pumping chamber for delivering pressurized water to the fire sprinkler system. An expansion tank is flow connected to the discharge line of the pumping chambers to balance the pressure in the discharge line whereby pulsing of the discharge water to the fire sprinkler system is eliminated.

7 Claims, 4 Drawing Sheets

METHOD AND APPARATUS FOR PROVIDING PRESSURIZED WATER TO A RESIDENTIAL FIRE SPRINKLER SYSTEM IN THE ABSENCE OF ELECTRICITY

BACKGROUND OF THE INVENTION

This invention relates to a residential fire extinguishing system and more particularly to a system for providing pressurized water to a N.F.P.A. 13D, residential fire sprinkler system without the use of electricity.

There are many residential buildings that are built in outlining areas that do not have access to a municipal water supply. These residences must rely for their source of water upon wells. While these residences do not have municipal water, they do have electricity for powering electric pumps to deliver water from the wells. Many of the new residential buildings are provided with residential fire sprinkler systems due to the absence of fire hydrants and also the nearest fire company may be several miles away. While the electric pump can function to supply water from the well to the sprinkler system, if the source of electricity is interrupted, the pump will no longer function. Under these circumstances, in the event of a fire, the pump is unable to supply water to the residential fire sprinkler system. This problem is not only serious where the water supply is derived from a well but is also serious where there is access to a municipal water supply. The reason for this is that the water to be supplied to a fire sprinkler system must be from a source of pressurized water. Thus areas with frequent power outage due to storms and brown outs present a serious problem for a residential fire sprinkler system regardless of the source of water.

Accordingly, it would be desirable to be able to supply a source of pressurized water to a residential fire sprinkler system without the use of electricity in any form.

SUMMARY OF THE INVENTION

It is an object of the present invention to provide a method and apparatus for providing a source of pressurized water to a residential fire sprinkler system in the absence of electricity.

In accordance with one aspect of the invention, there is a system for providing a source of pressurized water to a residential fire sprinkler system in the absence of electricity. The system includes a double diaphragm pump including a housing containing a pair of flexible diaphragms mechanically connected and separating the housing into a pair of pressure chambers and a pair of pumping chambers. Valve means are connected with the pair of pressure chambers for alternately supplying compressed nitrogen gas from a supply through an inlet port to the pressure chambers and alternately discharging the gas from the chambers to a discharge port. Each of the pumping chambers is provided with a pair of check valves at the opposite ends thereof. A first flow connection is provided between the check valves at one end of the pumping chambers and a second flow connection is provided between the check valves at the other end of the pumping chambers. A section line is connected with the first flow connection and a water supply and a discharge line is connected with the second flow connection for delivering water to the fire sprinkler system. A check valve is located in the discharge line and an expansion tank is flow connected to the discharge line. between the check valve and the second flow connection to balance the pressure in the discharge line to eliminate pulsing of the discharge water to the fire sprinkler system. Further in accordance with the invention an audible alarm is connected to the discharge port for operation by the gas discharge from the pump pressure chambers. Further in accordance with the invention a pressure gauge is connected to the discharge line between the check valve and the discharge outlet.

In accordance with a further aspect of the invention, in a system for providing a source of pressurized water to a residential fire sprinkler system in the absence of electrical energy utilizing a double diaphragm pump including a housing containing a pair of flexible diaphragms mechanically connected and separating the housing into a pair of pressure chambers and a pair of pumping chambers, there is provided the method including the steps of connecting the pressure chambers to a supply of compressed nitrogen gas, connecting the inlet to the pumping chambers to a water supply, connecting the outlet from the pumping chambers to a residential fire sprinkler system, alternately supplying the compressed nitrogen gas to the pressure chambers and alternately discharging the gas from the pressure chambers thereby causing water from the water supply to flow alternately into one of the pumping chambers and to be discharged alternately from the other of the pumping chambers for delivering water to the fire sprinkler system, and flow connecting an expansion tank to the discharge line of the pumping chambers to balance the pressure in the discharge line whereby pulsing of the discharge water to the fire sprinkler system is eliminated.

Figure 1:
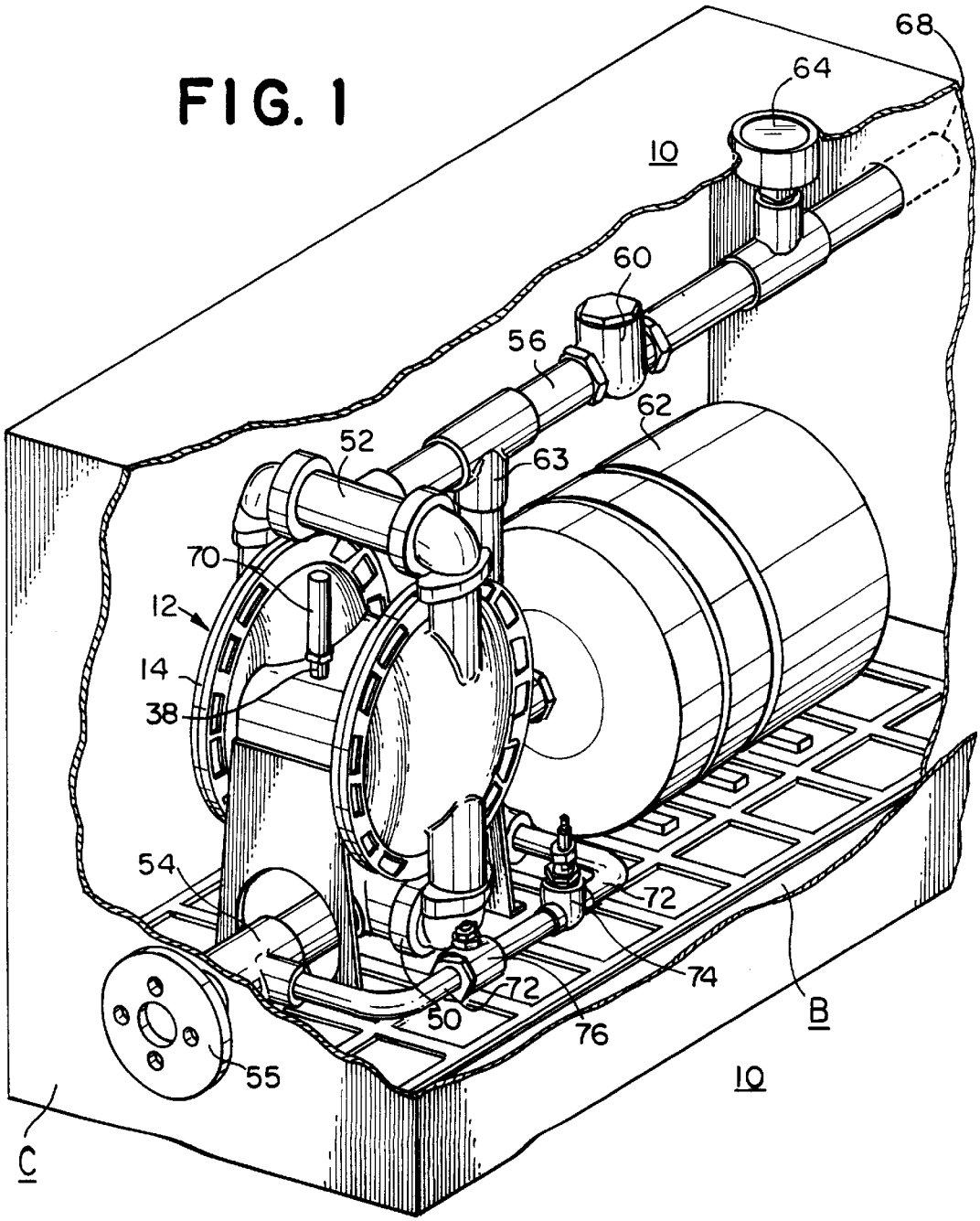
FIG. 1 is a perspective view of a system for providing a source of pressurized water to a residential fire sprinkler system in the absence of electricity according to the present invention. A portion of the system housing has been broken away for clarity.
Figure 2:
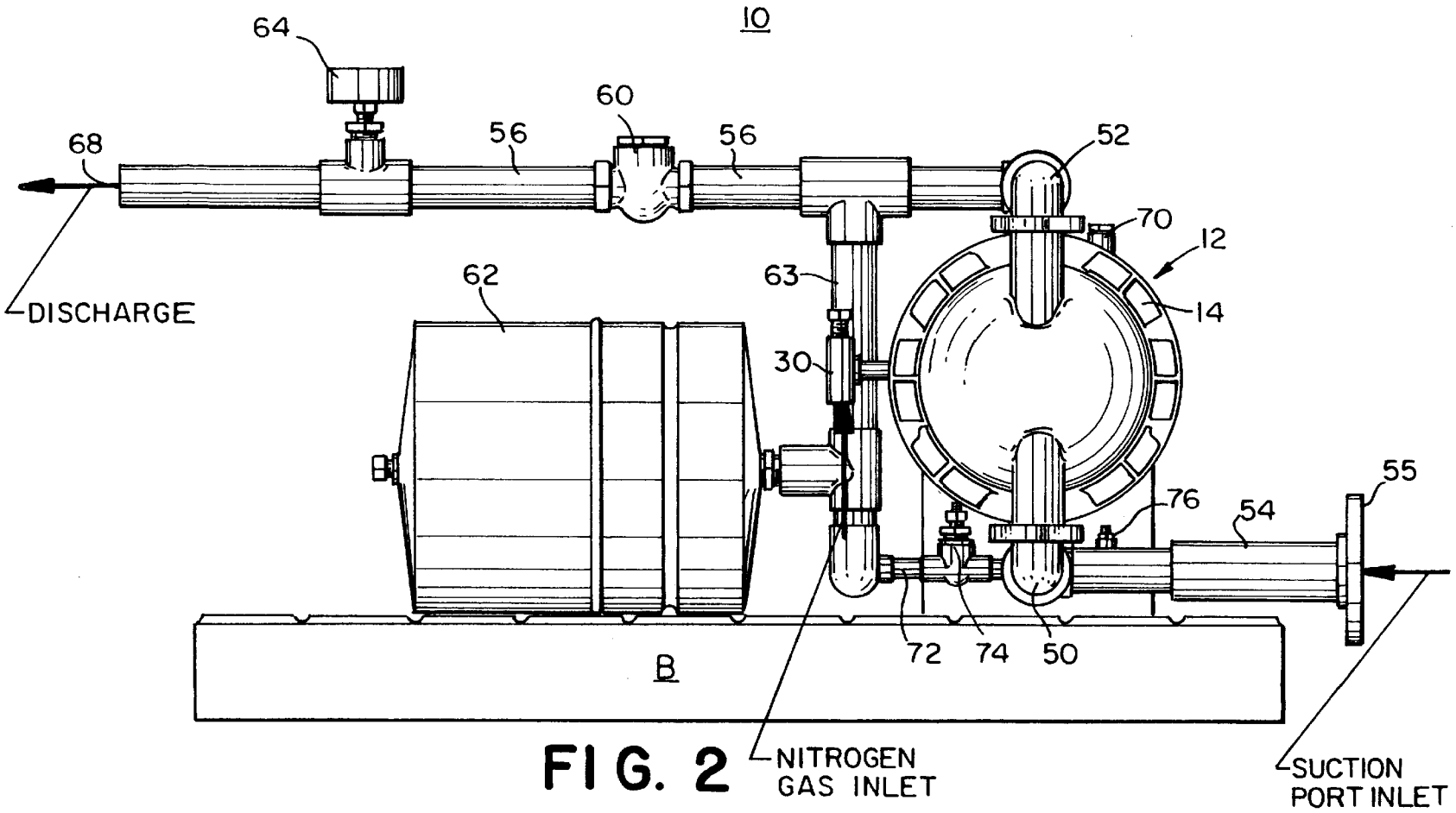
FIG. 2 is a rear elevational view of the system illustrated in FIG. 1.
Figure 3:
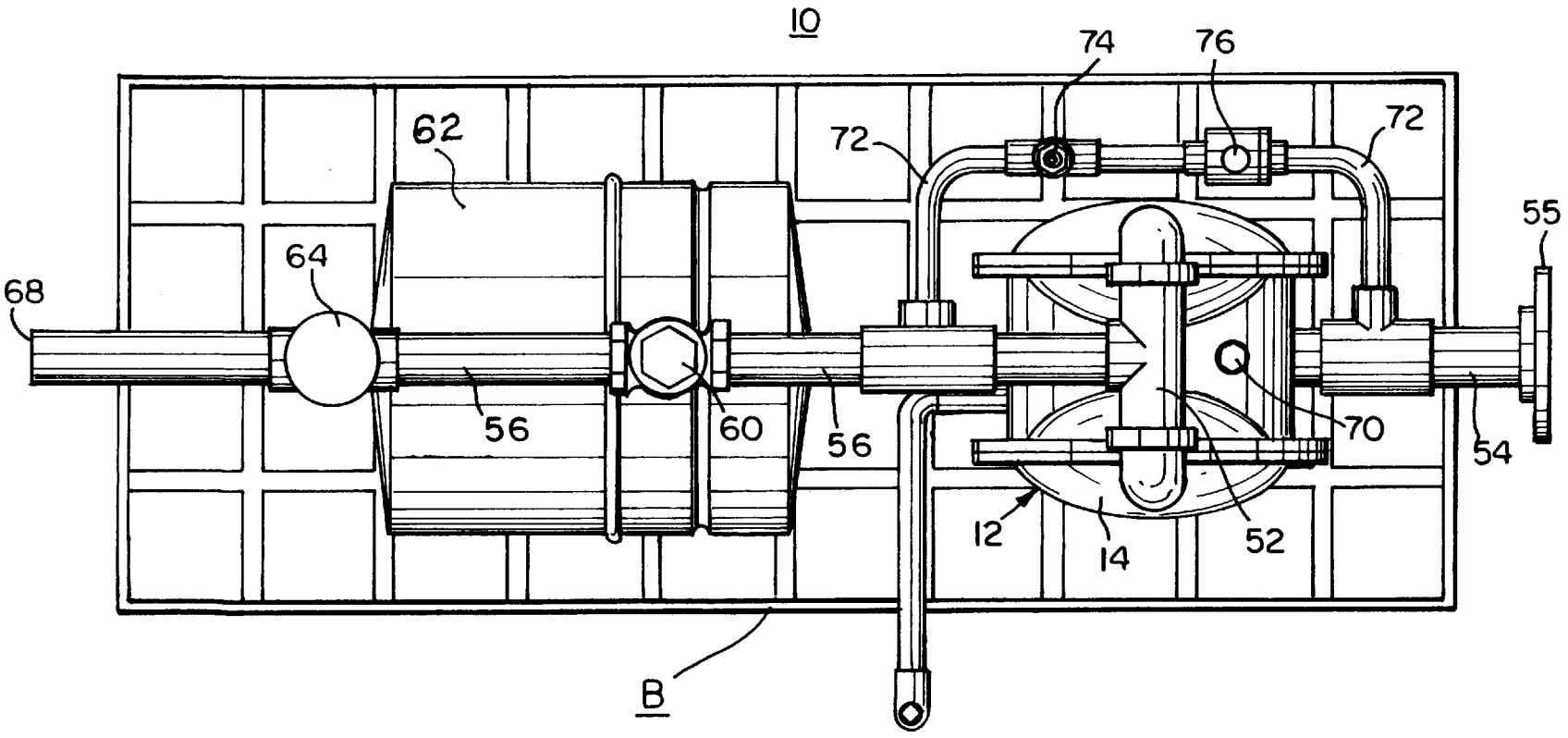
FIG. 3 is a top plan view of the system illustrated in FIG. 2.
Figure 4:
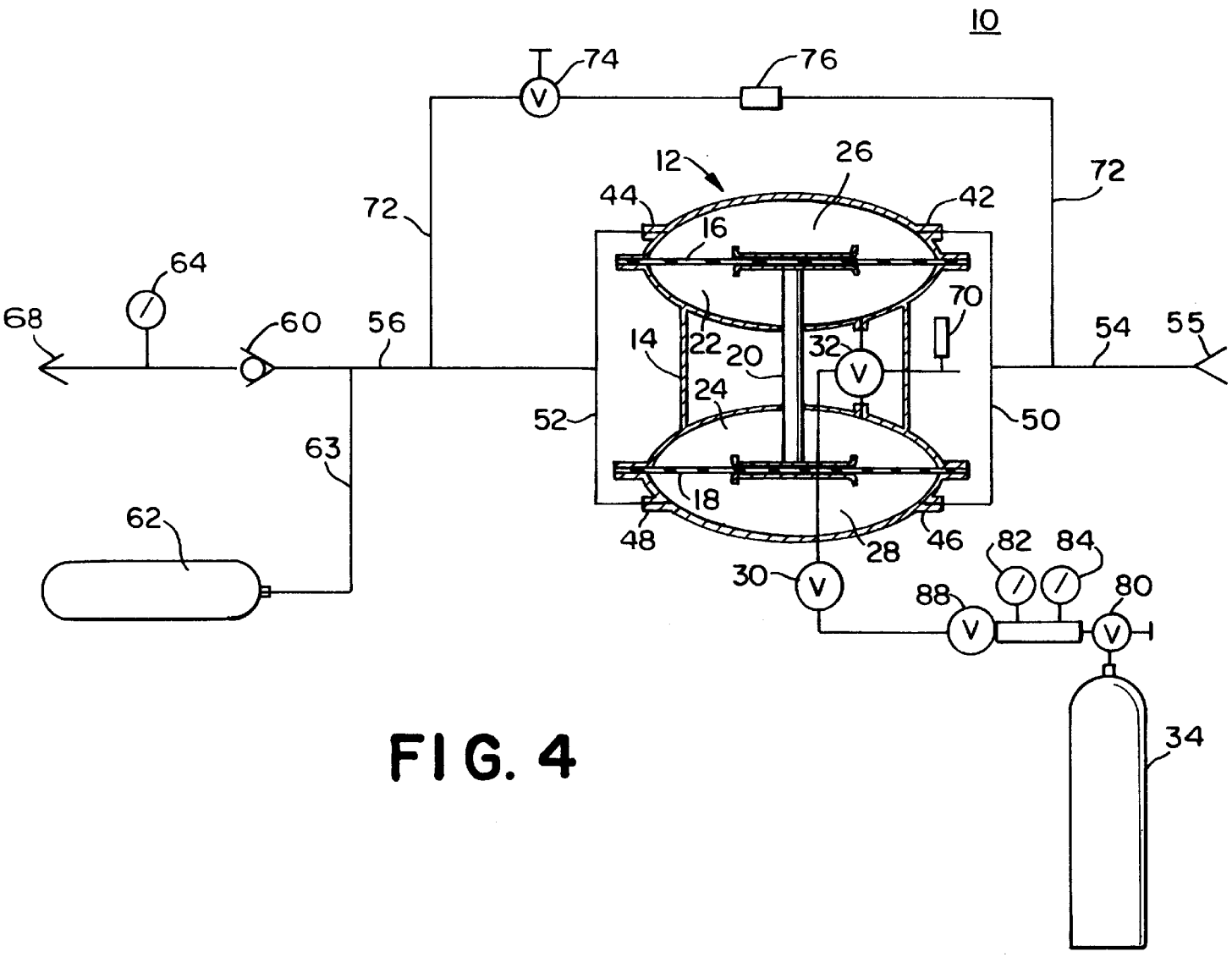
FIG. 4 is a schematic diagram of the piping in the present invention shown in FIGS. 1–3.

DESCRIPTION OF THE PREFERRED EMBODIMENT.

Referring to FIGS. 1–4 there is illustrated a system for providing a source of pressurized water to a fire sprinkler system in the absence of electricity according to the present invention. The system 10 includes a double diaphragm pump 12 including a housing 14 containing a pair of flexible diaphragms 16 and 18, FIG. 4, mechanically connected by a shaft 20. The diaphragms 16 and 18 divide the housing into a pair of pressure chambers 22 and 24 and a pair of pumping chambers 26 and 28. The double diaphragm pump 12 is of the type disclosed in U.S. Pat. No. 4,854,832, the disclosure of which is incorporated herein by this reference thereto. The double diaphragm pump 12 includes a suitable valve arrangement 32 connected with the pair of pressure chambers 22 and 24 for alternately supplying compressed nitrogen gas by way of inlet port 30 from a supply 34 to the pressure chambers 22 and 24 and alternately discharging the gas from the chambers through a discharge port 38. Each of the chambers 26 and 28 is provided with a pair of check valves, 42, 44 and 46, 48 at the opposite ends thereof. A first flow connection 50 connects the check valves 42 and 46 at one end of the pumping chambers 22 and 28 and a second flow connection 52 connects the check valves 44 and 48 at the other end of the pumping chambers 22 and 28. A suction line 54 is connected with the first flow connection 50 and an inlet 55 to a water supply. A discharge line 56 is connected with the second flow connection 52 for delivering water to the fire sprinkler system. A check valve 60 is located in the discharge line 56 and an expansion tank 62 is flow connected by way of pipe 63 to the discharge line 56 between the check valve 60 and the second flow connection 52 to balance the pressure in the discharge line 56 to eliminate pulsing of the discharge water to the fire sprinkler system. Since double diaphragm pumps normally discharge with a strong pulsing action, the expansion tank 62 is a small bladder equipped expansion tank which is pressure balanced to eliminate most of the pulsation. An example of a suitable expansion tank is Model No. WX-101 available commercially from Amtrol Inc. The bladder in the expansion tank 62 prevents it from becoming water logged over an extended period of down time. A pressure gauge 64 is connected in the discharge line 56 between the check valve 60 and the discharge outlet 68. An audible alarm 70 is connected to the discharge port 38 for operation by the gas discharged from the pump pressure chambers 22 and 28.

The system 10 also includes a provision for checking for leaks. This provision includes a bypass manifold 72 connected across the first and second flow connections 50 and 52 at the ends of the pumping chambers 26 and 28 whereby air pressure may be applied uniformly to both sides of the pump and all related flow connections to check for leaks and to torque set all of the fittings on the double diaphragm pump. The manifold piping 72 includes a ball valve 74 and a Schrader valve 76. After the tests have been completed the manifold 72 is closed off via the ball valve 74 and the Schrader valve 76 is cemented shut. The pump 12 is then ready to be operated to check for proper performance.

The gas cylinder 34 contains nitrogen gas and thereby eliminates moisture or water in the power supply that could freeze up the pump in cold weather applications. Nitrogen gas cylinders are commonly used in medical facilities, welding shops, etc. Under the code (NFPA 13D) a residential fire sprinkler system is required to deliver water for 10 minute duration. Depending on the water and pressure demand of the sprinkler system the pump will be able to deliver water for the code required ten minute duration on one, or possibly two gas cylinders. The pressure and gallons per minute are controlled by adjusting the incoming gas pressure to the pump. This is very close to a one to one ratio, with a small mechanical loss through the pump itself. Since diaphragm pumps typically bleed air or gas even when idle, the pump should have a positive shut off so it will not lose gas when idle. As may be seen in FIG. 4, the supply tank 34 for the nitrogen gas is provided with a shut off valve 80, a pressure gauge 82 and a volume gauge 84. The output from the gas supply tank 34 is connected by way of flexible gas line hose 86 to the gas inlet port 30 on the system 10. The gas line hose 86 preferably is connected to the outlet from the gas supply tank 34 by way of an automatic adjustable run-away control valve 88. It is also preferable that the gas line hose 86 be installed on the site inside a CPVC pipe to help prevent accidental severing of the line.

As may be seen in FIG. 1, the pumping unit is mounted on a base B within a housing or cabinet C. The base B is preferably a PVC "air pad" base and the cabinet C is preferably a metal cabinet such for example as aluminum. The pump and associated piping are factory sealed within the cabinet C with pop rivets to prevent anyone from attempting to modify the assembly in the field, tampering with the torque fasteners or copromising the operation of the pump after it is installed. In one embodiment of the invention the cabinet C had a length of 30", a height of 18" and a width of 12". Thus it will be seen that the system 10 is compact and particularly suitable for residential use. The pump 12 may be of the type having a metallic housing or a non-metallic housing. Examples of suitable double diaphragm pumps that have been used by the applicant are pumps having one-inch ports with a maximum G.P.M. (liters) from 35 to 40 and are available commercially under Base Model No. 6661 from Ingersoll-Rand Company. The non-metallic housing is preferable if the pump is to be installed in a climate where it is exposed to sub-freezing temperatures. The metallic pump is stronger than the other but it would be possible to have a functioning fire sprinkler system in a home, without electricity, in sub-freezing temperatures if all of the water in the system and storage tank is treated with a potable anti-freeze liquid. However, most of the available potable anti-freeze liquids will become "slushy" in temperatures below minus 20° F., and will not allow the water to pass through the sprinkler heads.

The brass check valve 60 installed in the pump discharge line 56 is for preventing excess back pressure from the sprinkler piping from damaging the system. Normally such excess pressure is developed by seasonal temperature fluctuations and their effect on the water filled piping within the home. The pressure gauge 64 in the discharge line 56 shows the home owner how much pressure is being held on the piping network. The gas pressure and volume can be read from the gauges 82 and 84 attached to the cylinder 34. The audible alarm 70 attached to the gas discharge port 38 referably is a metal fluted "whistle" device which operates from the gas discharge emitted from the pump 12. It will give off a loud tone only when the pump operates.

The following is a capacity chart for an example of a system constructed in accordance with the present invention.

| Regulator Setting/P.S.I. | G.P.M. Output (A) | Nitrogen Consumption Cu. Ft. /Min. (B) |
|---|---|---|
| 40 | 20 | 8.0 (C) |
| 55 | 25 | 15.6 (C) |
| 70 | 30 | 21.0 (C) |
| 85 | 34 | 30.2 (C) |
| 100 | 38 | 38.5 (C) |

The output figures listed above in the chart are plus or minus 5% and assume a 10 psi head pressure at 80° F., at sea level, at pump discharge outlet. In regard to the nitrogen consumption the cubic feet per minute is multiplied by 10 minutes for the systems site water duration. One standard "overfill" nitrogen cylinder contains between 290 and 300 cubic feet of available gas at 2400 psi. It is suggested that two cylinders be installed on all residential systems with a two head design. It is also recommended that 10% additional nitrogen gas consumption be added for each 15 pounds of head ressure over the 10 psi base used in calculating the figures for the G.P.M. output column above. In regard to the nitrogen consumption, it is also recommended that an allowance be made of 10 cubic feet per year for a 5 second quarterly test of the system by the home owner.

In the normal operating mode, the entire system is maintained under a pressure dictated by the regulator setting as indicated above. Upon release of water from the sprinkler system by a fused. sprinkler head, the pressure drops, and the pump begins to cycle in an effort to recover to its original setting. It will continue to pump water until it is manually shut off, the gas supply is totally consumed, or the water flow is terminated and pressure is restored. In this system, the pump can run without damage even if the water supply is exhausted or cut off. The pumping system of the present invention is also capable of delivering water to the sprinkler system even if the pumping module itself is totally submerged in water. The system of the present invention is sutable for one or two family residential structures as defined by the N.F.P.A. 13D fire code. It is suitable for installation in any home where a fire pump is necessary. Th cost is less than an electric pump and installation costs are reduced as the services of an electrician are not required. Potential applications include properties frequently vacant for extended periods of time such as hunting and fishing camps, ski resort properties, vacation homes, beach properties, etc. There are also other applications where meeting a specific fire code are not required such as small farm and agricultural buildings, stables, and small zones attached to or inside unprotected buildings. The term "residential" as used herein is intended to include such additional applications for small buildings.

While a preferred embodiment of this invention has been described and illustrated, it is to be understood that other modifications may be made within the scope of the appended claims.

What is claimed is:

1. A system for providing a primary source of pressurized water to a residential fire sprinkler system in the absence of electricity comprising a double diaphragm pump including a housing containing a pair of flexible diaphragms mechanically connected and separating said housing into a pair of pressure chambers and a pair of pumping chambers, valve means connected with said pair of pressure chambers for alternately supplying compressed nitrogen gas from a supply through an inlet port to said pressure chambers and alternately discharging said gas from said chambers through a discharge port, each of said pumping chambers having a pair of check valves at the opposite ends thereof, a first flow connection between said check valves at one end of said pumping chambers, a second flow connection between said check valves at the other end of said pumping chambers, a suction line connected with said first flow connection and for connection to a static water supply, a discharge line connected with said second flow connection for delivering pressurized water to the fire sprinkler system, a check valve in said discharge line, and an expansion tank flow connected to said discharge line between said check valve and said second flow connection to balance the pressure in said discharge line to eliminate pulsing of the discharge water to the fire sprinkler system.

2. A system for providing a primary source of pressurized water to a residential fire sprinkler system in the absence of electricity according to claim 1 including an audible alarm connected to said discharge port for operation by the gas discharge from the pump pressure chambers.

3. A system for providing a primary source of pressurized water to a residential fire sprinkler system in the absence of electricity according to claim 1 including a pressure gauge connected to the discharge line between said check valve and the discharge outlet.

4. In a system for providing a primary source of pressurized water to a residential fire sprinkler system in the absence of electrical energy utilizing a double diaphragm pump including a housing containing a pair of flexible diaphragms mechanically connected and separating the housing into a pair of pressure chambers and a pair of pumping chambers, the method comprising the steps of connecting the pressure chambers to a supply of compressed nitrogen gas, connecting the inlet to the pumping chambers to a static water supply, connecting the outlet from the pumping chambers to a residential fire sprinkler system, alternately supplying the compressed nitrogen gas to the pressure chambers and alternately discharging the gas from the pressure chambers thereby causing water from the static water supply to flow alternately into one of the pumping chambers and to be discharged alternately from the other of the pumping chambers for delivering pressurized water to the fire sprinkler system, and flow connecting an expansion tank to the discharge line of the pumping chambers to balance the pressure in the discharge line whereby pulsing of the discharge water to the fire sprinkler system is eliminated.

5. In a system according to claim 4 the method including the step of monitoring the discharge of gas from the pump with an audible alarm.

6. In a system for providing a primary source of pressurized water to a residnetial fire sprinkler system in the absence of electricity comprising a double diaphragm pump including a housing containing a pair of flexible diaphragms mechanically connected and separating said housing into a pair of pressure chambers and a pair of pumping chambers, valve means connected with said pair of pressure chambers for alternately supplying compressed nitrogen gas from a supply through an inlet port to said pressure chambers and alternately discharging said gas from said chambers through a discharge port, each of said pumping chambers having a pair of check valves at the opposite ends thereof, a first flow connection between said check valves at one end of said pumping chambers, a second flow connection between said check valves at the other end of said pumping chambers, a suction line connected with said first flow connection and for connection to a water supply, a discharge line connected with said second flow connection for delivering pressurized water to the fire sprinkler system, a check valve in said discharge line, and an expansion tank flow connected to said discharge line between said check valve and said second flow connection to balance the pressure in said discharge line to eliminate pulsing of the discharge water to the fire sprinkler system, and a bypass manifold connected across said first and second flow connections at the ends of said pumping chambers whereby air pressure may be applied uniformly to both sides of the pump and all related flow connections to check for leaks, and valve means in said bypass manifold for closing said bypass after the testing is completed.

7. A system for providing a source of pressurized water to a residential fire sprinkler system in the absence of electricity comprising a double diaphragm pump including a housing containing a pair of flexible diaphragms mechanically connected and separating said housing into a pair of pressure chambers and a pair of pumping chambers, valve means connected with said pair of pressure chambers for alternately supplying compressed nitrogen gas from a supply through an inlet port to said pressure chambers and alternately discharging said gas from said chambers through a discharge port, each of said pumping chambers having a pair of check valves at the opposite ends thereof, a first flow connection between said check valves at one end of said pumping chambers, a second flow connection between said check valves at the other end of said pumping chambers, a suction line connected with said first flow connection and for connection to a water resupply, a discharge line connected with said second flow connection for delivering pressurized water to the fire sprinkler system, a check valve in said discharge line, and an expansion tank flow connected to said discharge line between said check valve and said second flow connection to balance the pressure in said discharge line to eliminate pulsing of the discharge water to the fire sprinkler system, wherein said system includes a base and a housing, and wherein said system is mounted on said base and sealed within said housing, said inlet gas port, said section-line and said discharge line being accessible from the exterior of said housing.

* * * * *

UNITED STATES PATENT AND TRADEMARK OFFICE

CERTIFICATE OF CORRECTION

PATENT NO. : 5,979,563

DATED : November 9, 1999

INVENTOR(S) : Robert K. Fritz

It is certified that error appears in the above-identified patent and that said Letters Patent is hereby corrected as shown below:

Col. 3, line 64, "copromising" should be -compromising-

Col. 4, line 51, "ressure" should be -pressure-

Col. 5, line 1, "sutable" should be -suitable-.

Col. 6, line 9, "residnetial" should be -residential

Signed and Sealed this

Twenty-third Day of May, 2000

*Attest:*

Q. TODD DICKINSON

*Attesting Officer*

*Director of Patents and Trademarks*